US006003732A

United States Patent [19]

Farley et al.

[11] Patent Number: 6,003,732

[45] Date of Patent: Dec. 21, 1999

[54] HEATED PLATEN FOR LIQUEFYING THERMOPLASTIC MATERIALS

[75] Inventors: Mark Harrison Farley, Simi Valley, Calif.; Gregory J. Gabryszewski, Lithonia, Ga.; James W. Keough, Atlanta, Ga.; Laurence Bruce Saidman, Duluth, Ga.

[73] Assignee: Nordson Corporation, Westlake, Ohio

[21] Appl. No.: 08/962,341

[22] Filed: Oct. 31, 1997

Related U.S. Application Data

[63] Continuation-in-part of application No. 29/060,507, Sep. 30, 1996, Pat. No. Des. 387,074.

[51] Int. Cl.[6] ..... B67D 5/62

[52] U.S. Cl. ..... 222/146.5; 222/389; 222/405

[58] Field of Search ..... 222/146.5, 386, 222/389, 405

[56] References Cited

U.S. PATENT DOCUMENTS

| | | | |
|---|---|---|---|
| 2,478,893 | 10/1949 | Brant | 241/65 |
| 2,630,248 | 8/1953 | Hinz | 222/258 |
| 3,282,469 | 11/1966 | Skonberg | 222/146 |
| 3,412,903 | 11/1968 | Riper, Jr. et al. | 222/146 |
| 3,546,430 | 12/1970 | Kane | 219/316 |
| 3,637,111 | 1/1972 | McCreary | 222/146 H |
| 3,758,003 | 9/1973 | Kautz et al. | 222/146 R |
| 3,976,229 | 8/1976 | Jackson | 222/146 HE |
| 3,982,669 | 9/1976 | Moore | 222/146 HE |
| 4,073,409 | 2/1978 | Gardner et al. | 222/146 HE |
| 4,090,640 | 5/1978 | Smith et al. | 222/52 |
| 4,195,755 | 4/1980 | Slautterback et al. | 222/146 HE |
| 4,227,069 | 10/1980 | Gardner et al. | 219/421 |
| 4,344,547 | 8/1982 | Moore | 222/146.5 |
| 4,592,491 | 6/1986 | Chollet | 222/146.5 |
| 4,632,277 | 12/1986 | Pallente | 222/146.2 |
| 4,635,820 | 1/1987 | Marshall | 222/405 |
| 4,661,688 | 4/1987 | Gabryszewski | 219/421 |
| 5,148,947 | 9/1992 | Epp et al. | 222/146.5 |
| 5,257,723 | 11/1993 | Bagung | 222/146.5 |

OTHER PUBLICATIONS

Nordson® Bulk Melter/Applicators (Issued Jul. 1979), Nordson Corporation.

Nordson® Product Information, Model 5505 Bulk Melter/Applicator (Issued 1981–1982); Nordson Corporation.

Nordson® Model 5505 & Model 5510 Bulk Melter/applicator Systems (Issued May 1980) Nordson Corporation.

Nordson® Bulk Melter Systems (Issued Sep. 1990), Nordson Corporation.

Meltex® Drum Melter DG 21, Meltex Corp. (published on or before 1989).

Meltex® Information Drum Melters, Meltex Corp. (published on or before 1989).

Nordson® Series 5000 Drum Melters Options (Publication, Issued Feb. 1992), Nordson Corp.

Meltex® Drum Unloader DP 201, Meltex Corp. (published on or before 1989).

UNIflow® Platen Options.

Meltex® Hydraulic Drum Melter DG 201 H, Meltex Corp. (published on or before 1989).

Meltex® Drum Melter DG 201, Meltex Corp. ( Feb. 1991).

Meltex® Information Fassschmelzer, Meltex Corp. (1986).

UNIflow® Fibre Drum Unloader; Mercer Corporation.

DM–55P Bulk Unloader/Dispenser System; LTI Corporation (Aug. 1982).

LTI's DM55 Drum Unloader/Dispenser; LTI Corporation.

Dynamelt® 5; Portable Hot Melt Unloader/Dispenser; GRACO LTI.

Dynamelt® DM–55 Hot Melt Unloader/Dispenser; GRACO LTI.

*Primary Examiner*—Joseph A. Kaufman

*Attorney, Agent, or Firm*—Wood, Herron & Evans, L.L.P.

[57] ABSTRACT

A platen for use with the heating and melting of thermoplastic material from bulk containers is disclosed. The platen includes channels having a channel depth that varies and increases to a maximum depth near the center of the platen.

18 Claims, 6 Drawing Sheets

HEATED PLATEN FOR LIQUEFYING THERMOPLASTIC MATERIALS

RELATED APPLICATIONS

This application is a continuation-in-part of U.S. Pat. application Ser. No. 29/060,507 filed on Sep. 30, 1996, now U.S. Pat. No. Des. 387,074.

BACKGROUND OF THE INVENTION

This invention relates to the heating and melting of thermoplastic material from bulk containers. More particularly, this invention relates to the heating and melting of thermoplastic materials, such as hot melt adhesives, from containers, such as 55-gallon drums, 5-gallon pails, etc., such that the liquefied material may be pumped from the container for subsequent use by other application equipment.

There are a number of hot melt dispensers which liquefy and dispense thermoplastic materials, such as hot melt adhesives, which permit dispensing the material directly from the shipping container (drum, barrel, pail, etc.). One such common device includes an arrangement in which a heated element is lowered directly into the open end of the container for liquefying or melting the thermoplastic material in the region directly below this heating element. Typically, the heated element is a heated platen for liquefying the material so that a pump may pump the liquefied material to equipment for dispensing the material onto a substrate. Such apparatus would include those shown in U.S. Pat. Nos. 3,412,903; 3,637,111; 4,227,069; 4,195,755; and 4,661,688, as well as the Meltex® DG-21 and DG-201, and the Nordson 500 Series and 5500 Series Drum Melters.

Commonly, the dispensing apparatus includes a heated follower plate assembly, or platen assembly, which includes a pair of gaskets about its periphery, a pump for pumping the liquefied material and a lower heated section which when placed within the container liquefies the thermoplastic material for delivery through suitable passageways to the inlet of the pump. Typically, the lower portion of the follower plate or platen comprises a number of segments that are heated and are releasably attachable to the plate. Finally, either a platform may be provided by means of which the container is elevated or a mechanism may be provided by which the plate assembly is lowered into the container.

The lower heated segments of the plate or platen may be smooth or they may be finned in design. Typically, the flat heated surfaces are useful for liquefying material in which a demand or melting rate of the material is low while the finned design is used in those instances where higher melt temperatures and/or greater flow rates are required.

In operation, the platen is inserted into the container. O-ring seals, or gaskets, come into contact with the inner peripheral surface of the container that contains the adhesive. The container is not filled to capacity because the gaskets must first come into contact with the container to form a proper seal in which to remove the material. By positioning the gaskets at the lower portion of the platen the amount of unfilled space at the top of the container is minimized. This positioning allows the container to be filled with more material and leads to better overall use of the container.

SUMMARY OF THE INVENTION

A platen used for liquefying and dispensing an adhesive from a container to a substrate, the platen comprises an integral design having a top portion, a bottom portion, a center, an outer periphery, a surface, a plurality of heating units, and a central portion. The central portion is located substantially about the center of the platen. The platen surface is substantially flat. One advantage of this configuration is that is can melt and therefore remove a maximum amount of adhesive from the drum. Another advantage of this configuration is that it minimizes the area for curable adhesives such as PUR's to cure and block flow.

The bottom portion of the platen has channels, preferably, six in number. The channels are spaced equidistantly apart. These relatively small channels can greatly increase the melting capacity of the unit over a truly flat platen. When the width and the depth of these channels is optimized, the channels contain only molten adhesive and the surface of the solid adhesive below is flat. There are no ridges of solid adhesive to block the channels. Thus the channels enable the drum to be emptied without leaving substantial amounts of excess adhesive in the drum. Another important benefit is that the channels do not provide an area where the material can cure and adhere to the drum. The channels are small enough so that 90% to 98% of the actual surface area of the platen is in direct contact with the solid adhesive. Because the channels provide a place for molten adhesive, essentially removing it from between the platen and the still solid adhesive, thermal conductivity is improved and melting capacity is improved substantially.

The channels extend radially inwardly from the outer periphery of the platen surface to the central portion of the platen surface and are angularly spaced equidistantly apart. The centerline of one channel is preferably 60° spaced from the centerline of an adjacent channel. The depth of the channels can range from 0.2 inches (0.51 cm) to 1.0 inches (2.54 cm) at the outer periphery. The depth of the channels at the periphery is preferably 0.4375 inches (1.11 cm), and uniformly increases from 1.0 inches (2.54 cm) to 3.0 inches (7.62 cm) at the central portion of the platen surface.

The width W of the channel can range from 0.125 inches (0.32 cm) and 0.250 inches (0.64cm). However, a channel having an optimized width W avoids ridges of solid adhesive when operated at a maximum melt rate. The channel provides adequate flow of molten adhesive from the periphery to the center of the platen.

The platen further comprises a cylindrical sidewall and a pair of elastomeric seals. The cylindrical sidewall has a pair of peripheral grooves. The pair of peripheral grooves accepts the pair of elastomeric seals, wherein the pair of peripheral grooves nest above the perimeter fins.

DETAILED DESCRIPTION OF THE PREFERRED EMBODIMENT OF THE INVENTION

Figure 1:
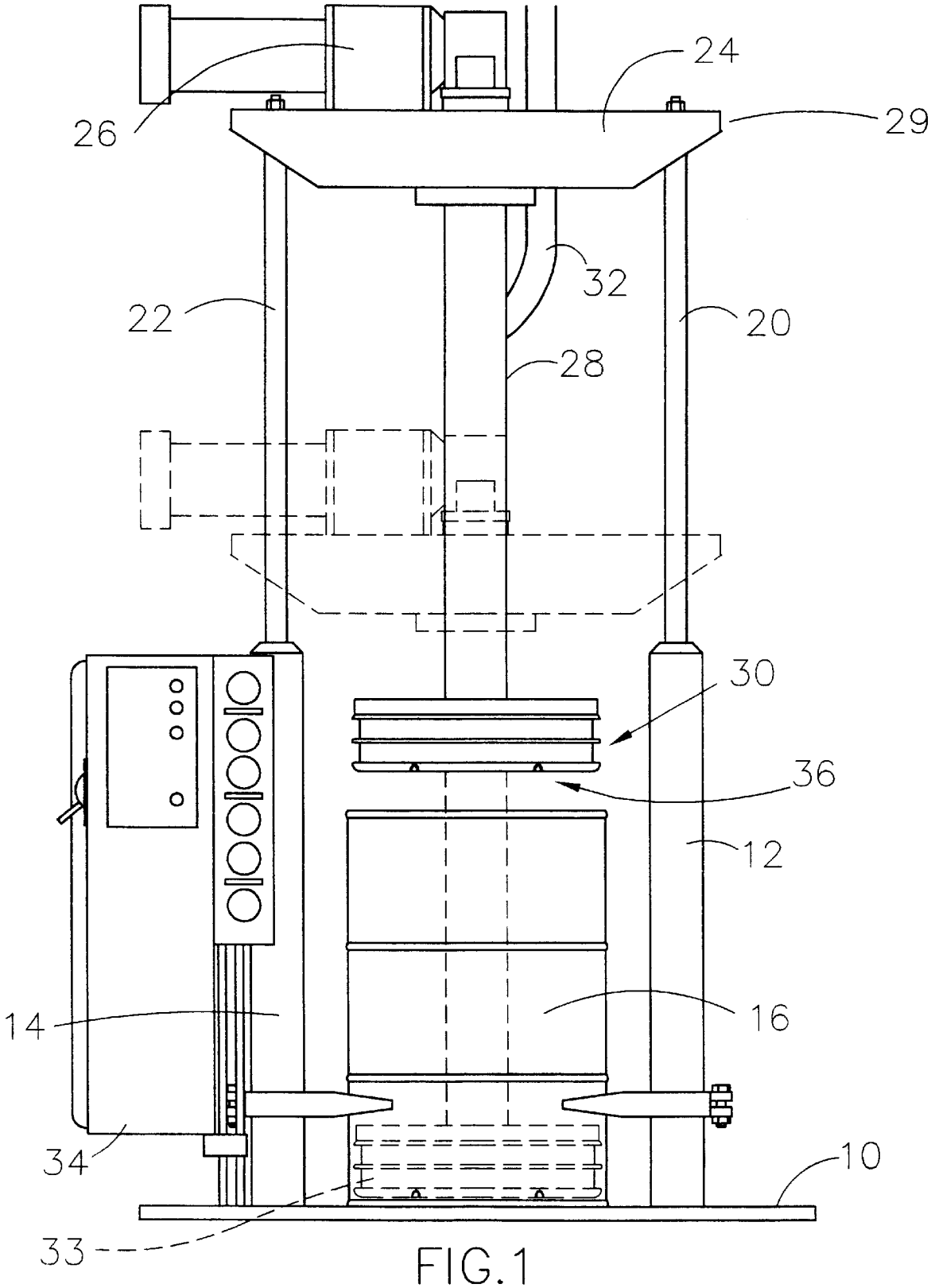
FIG. 1 is an elevational view of a hot melt pumping and dispensing apparatus in accordance with one aspect of this invention.

With reference to FIG. 1, there is illustrated an apparatus for heating and melting thermoplastic materials from a bulk container, such as in drums, cans, etc. The apparatus of FIG. 1 is especially suitable for the heating and liquefying to a pumpable condition hot melt adhesives, thereby making possible the dispensing of the hot melt adhesive onto a substrate by other application equipment (not shown). The apparatus includes a base plate 10 on which are supported a plurality of upright elements, such as a pair of upright support cylinders 12 and 14. The base plate 10 may also support a drum 16 from which the material is to be removed.

A pair of cylinder rods 20 and 22 extends upwardly from support cylinders 12 and 14, respectively. A crosshead member 24 joins the cylinder rods 20 and 22 at their upper ends. Crosshead member 24 may also support a pump drive motor assembly 26 as well as a tube 28.

A platen, indicated generally at 30, is attached to one end of the tube 28 such that the platen 30 may be raised or lowered into the drum 16. The platen 30 is shown in the raised or elevated position in FIG. 1 prior to being inserted into the drum 16. Pressurized air may be admitted into the support cylinders 12 and 14 to extend the cylinder rods 20 and 22 from the support cylinders 12 and 14 and to raise the crosshead member 24 and the associated structure supported thereon to an elevated position, as shown in FIG. 1 at 29. Similarly, pressurized air may be applied to the support cylinders 12 and 14 to cause the cylinder rods 20 and 22 to retract, and in turn cause the crosshead member 24 to move downwardly. This, in turn, causes the platen 30 to be inserted into the drum 16 so as to apply a force or pressure against the hot material in the drum 16. When the platen 30 is inserted into the opening of the drum 16, the platen 30 will begin to heat the hot melt material contained within the drum 16 until it is in a liquefied pumpable condition. In such a condition, the material may be pumped from the drum 16 via conduit or hose 32 for subsequent use by downstream equipment. As more and more material is removed from the drum 16, the platen 30 continues to be asserted further into the drum 16 until the platen 30 is at the bottom of drum 16, shown generally at 33 in phantom lines. Additionally, an electrical control panel 34 may be supported on the base plate 10 for providing the controls, including the temperature monitoring controls, necessary in the operation of the apparatus of FIG. 1.

With reference FIGS. 2–5, the platen 30 will be discussed in greater detail. In operation, the platen 30 includes a surface for engaging or coming in contact with the hot melt material, the surface shown generally as reference numeral 38, so that the hot melt material may be heated and liquefied to a pumpable condition. The platen 30 is constructed as an integral design. By "integral" it is meant that the platen 30 is essentially a single piece of material, rather than comprising segments which are bolted or otherwise fastened together. The integral design reduces cost by being able to use a permanent mold casting, thereby reducing machining and assembly costs.

With reference to FIGS. 1–5, in operation, surface 38 of the platen 30 would correspond to the lower most portion or the bottom of the platen face 36 when in use. The bottom portion 36 of the platen 30 comprises surface 38 that has a channel 40. In the preferred environment, the platen 30 includes 6 channels, however for ease of illustration, only one channel 40 will be described. In the preferred embodiment, each of the channels is identical in configuration, although it is within the scope of the invention to include channels of different configuration.

Figure 2:
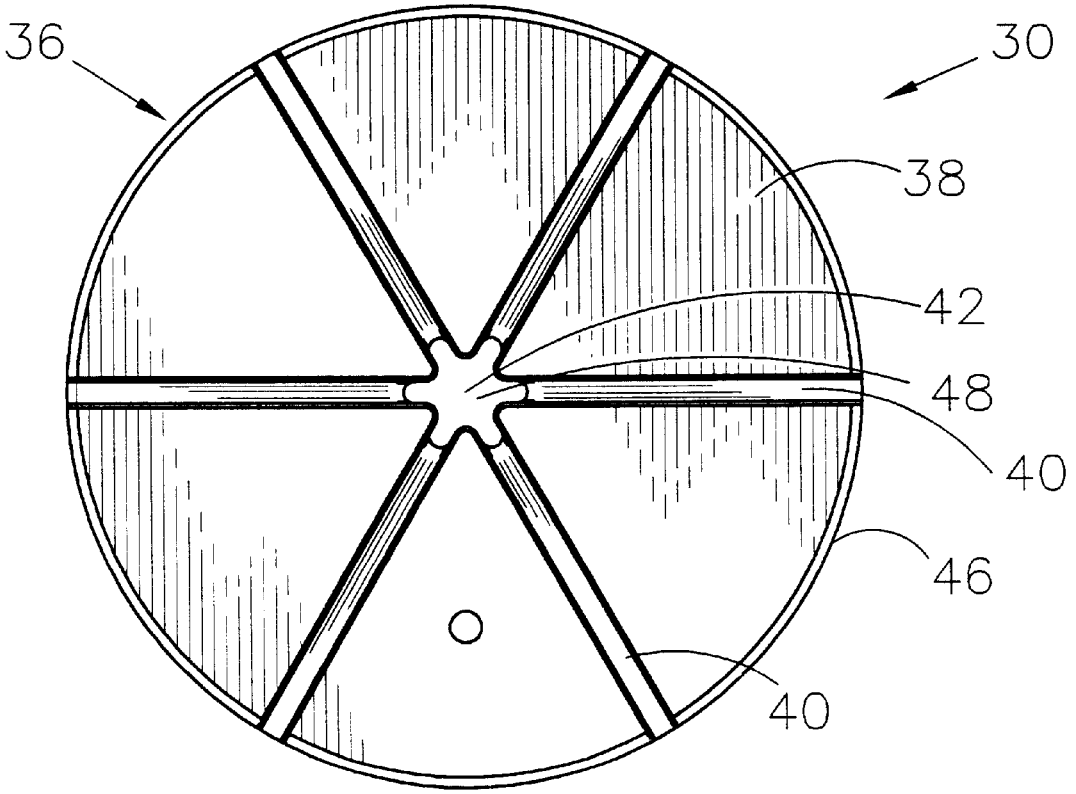
FIG. 2 is a plan view of a heated platen for liquefying thermoplastic materials.
Figure 3:
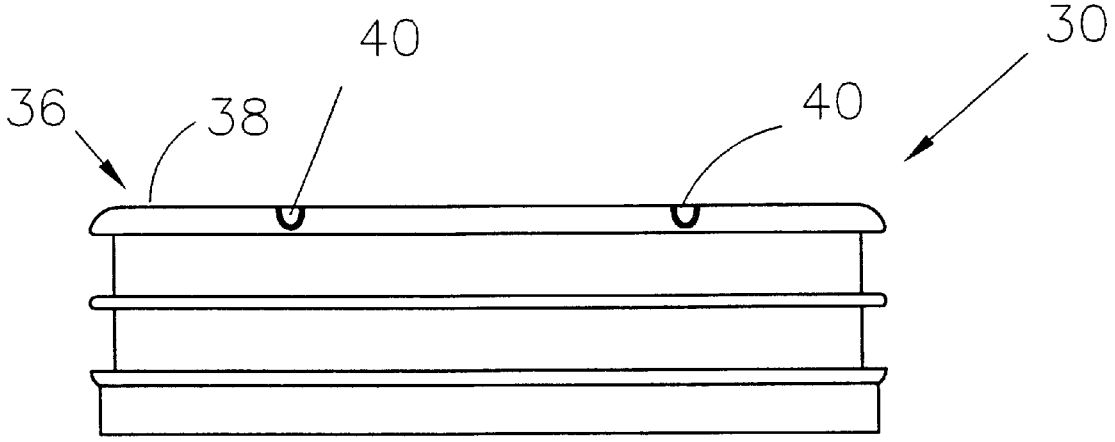
FIG. 3 is a side elevational view of the heated platen as oriented in FIG. 2, wherein the front, rear, and side views are all substantially identical.
Figure 4:
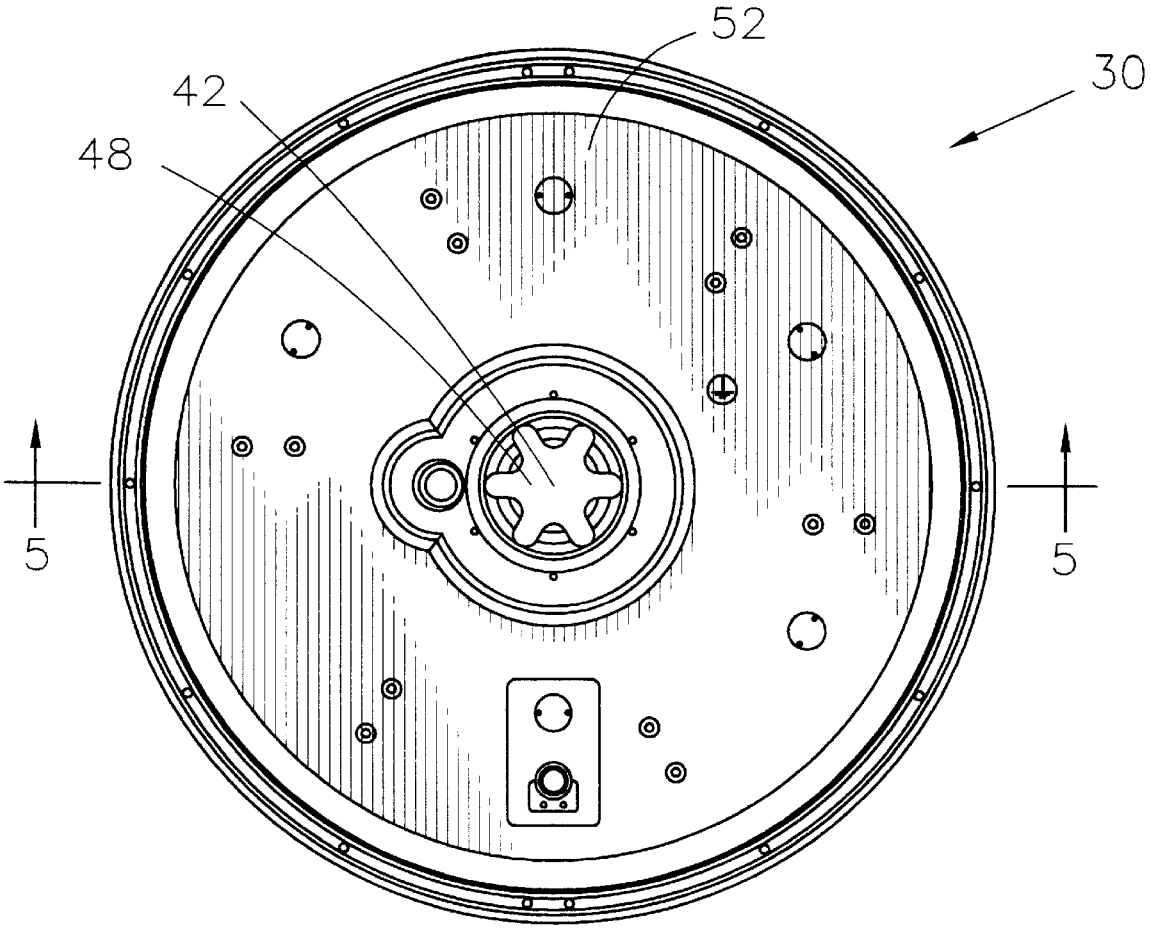
FIG. 4 is a top plan view of the heated platen, rotated 180° from the orientation of FIG. 2.
Figure 5:
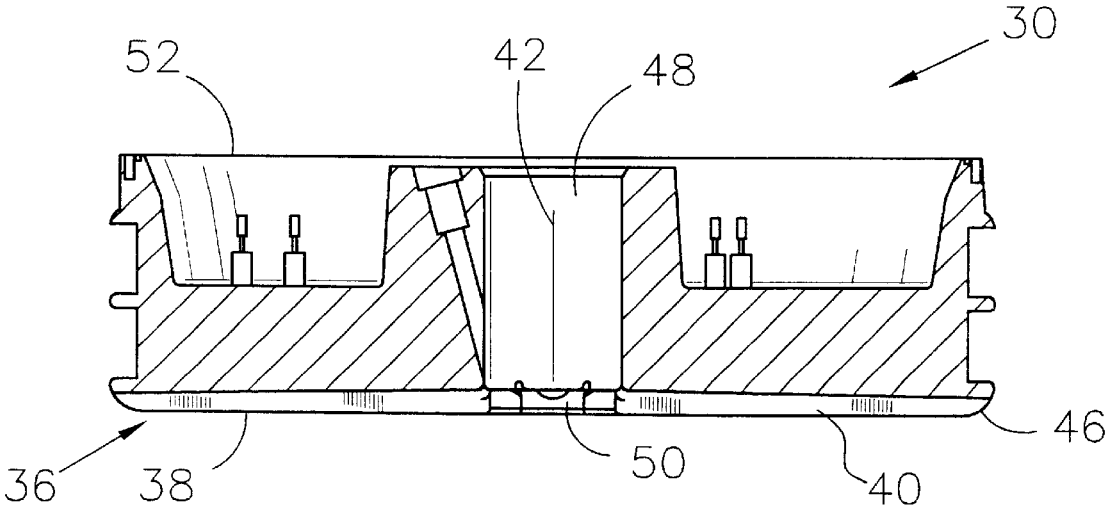
FIG. 5 is a cross-sectional view taken along line 5—5 of FIG. 4.

As is best illustrated in FIG. 2, the channel 40 extends from the outer periphery 46 radially inwardly to a central portion 48 located substantially about the radial centerline 42 of the platen 30. The central portion 48 includes a through bore 50 extending from the bottom portion 36 of the platen 30 to the top or upper face 52. The through bore 50 may be a stepped bore, wherein the smaller diameter portion of the bore extends from the bottom portion 36 of the platen 30.

The channel 40 extends from the outer periphery 46 of the platen 30 to the central portion 48. A pump inlet (not shown) is located at the central portion 48 and the pump (not shown) is capable of pumping the material within the drum 16 via a hose 32 for subsequent use by downstream equipment (not shown). The pump generates suction at the central portion 48. In response to the suction, the melted material begins to flow toward the central portion 48 and the pump inlet. Because the channel is accumulating material as it melts, the portion of the channel nearer the central portion 48 must accommodate more volume of flowing melted material than the areas of the channel 40 nearer the outer periphery 46.

To accommodate greater volume of flowing melted material, the depth of the channel 40 increases from the outer periphery 46 to the central portion 48. The rate of increase in depth of the channel 40 can be uniform or can vary along the channel 40. It is preferred that the depth of the channel 40 is greatest at the central portion 48. The preferred channel 40 increases in depth uniformly along the entire length Y of the channel 40 to a maximum depth at the central portion 48. The sides of the channel 40 provide additional heated surface area, as the sides of the channel also help melt the adhesive. At the outer periphery 46 the depth of channel 40 can reach between 0.2 inches (0.51 cm) to 1.0 inches (2.54 cm). The preferred depth of the channel 40 at the outer periphery 46 is 0.48 inches (1.11 cm). The preferred channel 40 increases in depth in a uniform manner radially inwardly towards the central portion 48. At the central portion 48 the depth of the preferred channel 40 is 1.00 inches (2.54 cm). However, at the central portion 48, the depth of the channel can range between 1.0 inches (2.54 cm) to 3.0 inches (7.62 cm).

Figure 7:
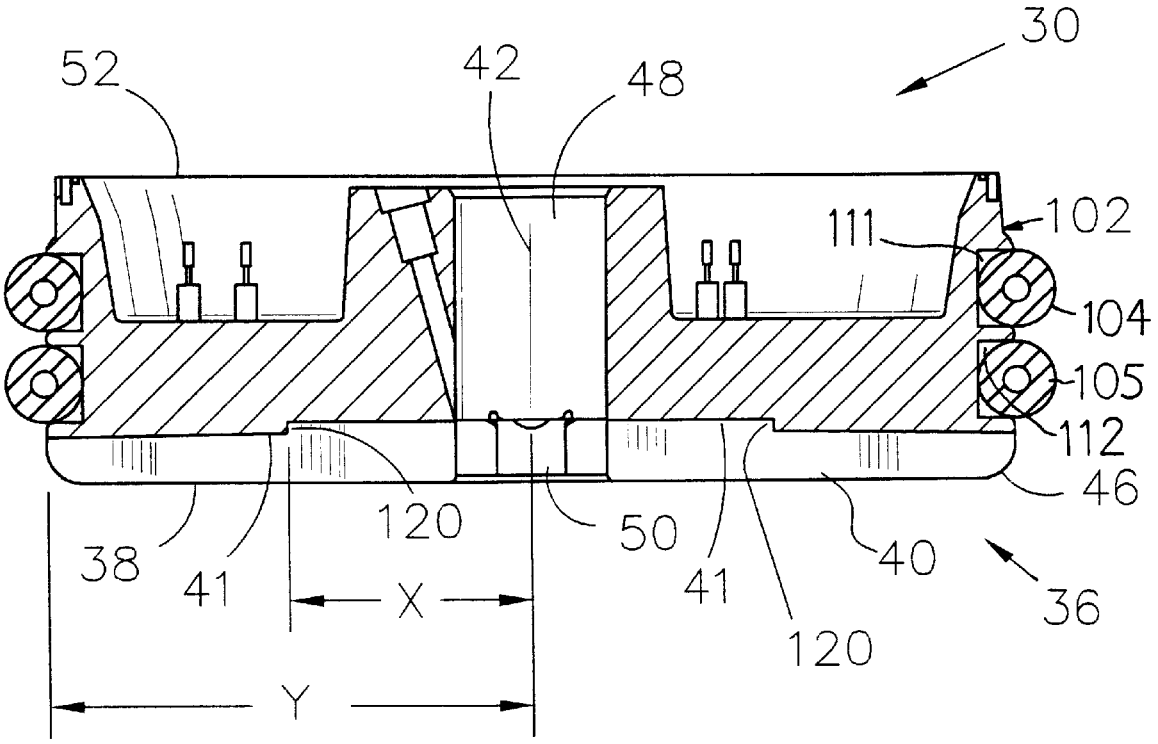
FIG. 7 is a cross-sectional view taken along line 5—5 of FIG. 4 showing an alternative embodiment of the channels; and, FIG. 8 is a graphical representation of channel depth D as a function of radial position r.

An alternative embodiment of the channels 40 is shown in FIG. 7. In this embodiment, the depth of the channel 40 increases in a non-linear manner. Instead, a step 120 is provided in the floor of the channel 40. The step 120 provides a rapid increase in volume of the channel. This sudden increase in channel volume can accommodate a surge of adhesive. In this configuration, the channels 40 increase in depth a length X measured outward from the centerline 42 of the platen 30. This distance X is preferably 3.0 inches (7.62 cm) but can increase to 6.0 inches (15.24 cm) or decrease to 2.0 inches (5.08 cm) and still provide the requisite increase in the flow volume.

With continuing reference to FIG. 7, in this embodiment of the invention the channel length Y is measured from the centerline 42 of the platen 30 to the outer periphery 46 of the platen 30. The distance Y is typically 11.0 inches (27.94 cm) or 12.0 inches (30.48 cm) measured from the centerline 42 of the platen 30. In this embodiment the depth of the channel 40 increases along a portion of its length. In the preferred embodiment, the channel 40 varies in depth for between 16% and 50% of its length and is of constant depth for the rest of its length. In the most preferred embodiment, the depth of the channel 40 increases along 25 % of the channel's length Y. This increase in depth can be step-like, as is illustrated with step 120, or can be more gradual.

With reference again to FIGS. 2–7, the channels 40 have a width W that is substantially uniform along their entire length Y. Preferably, the width W is equal to two times the typical melt layer thickness of the adhesive. It is preferred that the minimum width W of the channels 40 be no less than the melt layer thickness of the material to be liquefied and removed from the container 16. For typical packaging grade adhesives, this melt layer thickness minimum width W distance would be in the range from about 0.125 inches (0.32 cm) to 0.250 inches (6.35 mm). Preferably, this minimum width W spacing is 0.1875 inches (4.76 mm). Ideally, however, the width W should be spaced at about two times the melt layer thickness to provide good fluid flow. When the width W becomes too wide, insufficient heat is transferred to melt the adhesive below the channel 40. This results in a ridge of adhesive that blocks a portion of the channel 40. For this reason the channel depth can change to accommodate the flow requirement at various channel positions, but the width W remains constant. Observations of the operation of this unit and computational fluid flow models have shown that a given adhesive will form a typical melt layer thickness when the unit is operating at its maximum melting capacity. This layer is a form of a thermal boundary layer, and is determined by the thermal and viscous properties of the adhesive.

The depth D can be expressed as a function of the radial position r, where r is a radial distance from the outer periphery 46 of the platen 30. In formulaic terms, $$D = \left(\frac{K}{W}\right) * \prod * (R^2 - r^2),$$

where, R=radius of the platen; r=radius at which the depth is being evaluated; K=a constant to relate area creating flow to area receiving flow; W=2 * t; and, t=the typical molten layer thickness.

For example, upon experimental determination of the optimum depth D along a channel 40, the constant K is determined. Thereafter, the optimum depth D along any position r of the platen 30 can be determined. The above formula is derived by relating the surface area of the platen 30 that is melting adhesive and generating flow of melted adhesive to the cross-sectional area of the channel 40 available to carry the flow of melted adhesive to the pump.

Figure 8:
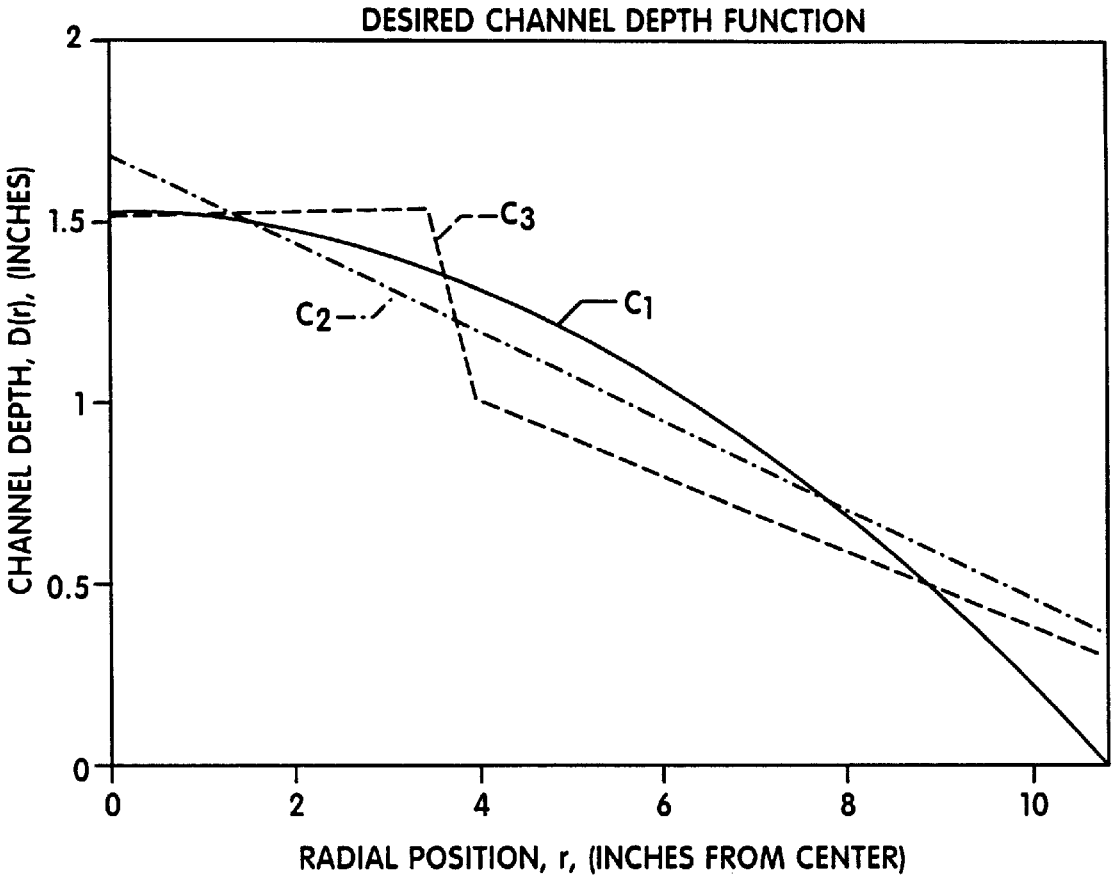

With reference to FIG. 8, the channel depth D is shown as a function of radial position r. The curve C1 is an ideal curve of an optimized channel 40 depth profile. The straight line C2 shows the depth profile of a channel 40 having a uniform increasing depth D. Lastly, C3 shows the depth profile for a channel 40 having a depth D that increases as a step as shown in FIG. 7. The fluid flow properties of the two channel 40 depth configurations are essentially the same, with differences being negligible.

Figure 6:
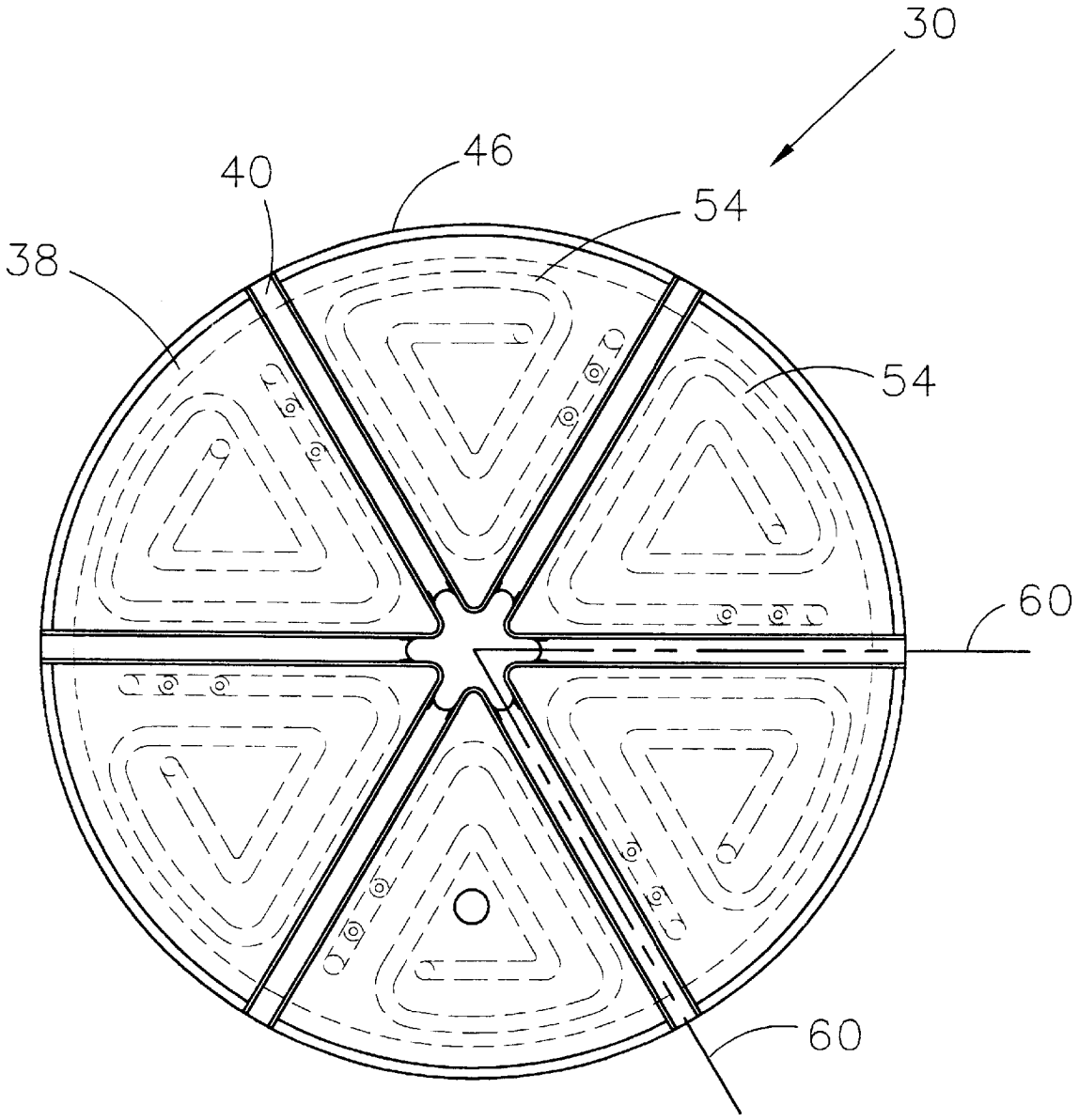
FIG. 6 shows a bottom view of the platen showing the preferred channel arrangement along with typical heating units shown in phantom lines.

With reference to FIGS. 2 and 6, a preferred embodiment of the present invention having six channels 40 within the bottom portion 36 of the platen 30 is illustrated. The platen 30, in its preferred embodiment, has six heating units 54 that are arranged in a triangular configuration. This heated configuration lends itself to having channels 40 consist of six within the bottom portion 36 of the platen 30. The heating units 54 are typically three-phase power heating units. The heating units 54 shown in FIG. 6 are identical to one another and are spaced apart uniformly about the platen 30 Different heating units 54 could be used which are smaller in shape and which would allow more channels 40 to be used with the platen 30. As such, platen 30 could have more or less channels 40. As different heating units 54 are applied to the invention the amount of channels 40 may change.

The six channels 40 are equally spaced around the platen 30, corresponding to 60 degree intervals measured from a centerline 60 of the one of the channels 40 to the centerline of the next adjacent channel 40. As such, the heating units 54 substantially cover the portion of the platen 30 divided by the channels 40, as shown in FIG. 6. Using different heating units of different capacities might change the number of channels 40 within the platen 30.

As shown in FIG. 7, a cylindrical sidewall 102 is formed with a pair of peripheral grooves 111, 112 that respectively accept a first elastomeric seal 104 and a second elastomeric seal 105. The seals 104, 105 engage the inside walls of the drum 16 to provide a fluid tight connection. It is important for the location of the seals 104, 105 are located as close to the bottom portion 36 of the platen 30 as possible. This allows the container 16 to have less space at its opening. The container 16 is thereby able to contain more adhesive. The container 16 must have some portion at the top to allow for the insertion of the platen 30 so that the seals 104, 105 can become engaged with the side of the container 16. Ideally, the bottom surface 36 contacts the surface of the adhesive at the same time the seals 104 engage with the interior of the container 16.

Optimizing fluid flow in the channels 40 results in a thinner layer of molten adhesive that is required under the flat areas, as less flow has to occur in the flat areas. This, in turn, minimizes the quantity of adhesive left in the drum 16. Also, heat must be transferred from the hot platen 30 through the molten layer into the solid adhesive in order to melt the adhesive. Thus, a thinner molten layer provides less resistance to heat flow, and increases the melt rate.

In operation, the platen 30 is inserted into the container 16 as discussed above. Upon insertion into the container 16 the bottom portion 36 and more specifically, surface 38, contacts the adhesive within the container 16 The "gross surface area" of the platen 30 will herein be defined to be the area defined by the periphery of the platen 30 without regard to the channels 40. The "net surface area" of the platen 30 will be the gross surface area of the platen 30 minus the surface area of the channels 40. The net surface area of the platen 30 is therefore the portion of the platen 30 that actually contacts the unmelted material in order to effect the melting process, ignoring the effects of the channel walls.

The net surface area of the platen 30 is dependent on the number and configuration of its components, namely the channels 40 and the dimensions of the platen 30 itself. The benefits of the invention are most attainable if the net surface area of the platen 30 is between 90% and 98% of the actual surface area of the platen 30. In the preferred embodiment the net surface area of the platen 30 is 96.7% of the gross surface area. The net surface area is affected by the preferred number of channels 40 being six (6), the width W of the channels being within the range of 0.125 inches (0.32 cm) to 0.250 inches (0.64 cm), the outer periphery 46 of the platen 30 being twenty-two (22) inches (56 cm), and the length Y of the channels being eleven (11) inches (28 cm). In the preferred embodiment, the channels 40 have a width W of 0.1875 inches (0.48 cm), length Y of eleven (11) inches (28 cm), the platen diameter D is twenty-two (22) inches (56 cm), and there are six channels per platen. This yields the channels 40 comprising 3.3 % of the gross surface area of the platen 38.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

Having thus described the invention, it is now claimed:

1. A platen used for liquefying and dispensing an adhesive from an associated container to an associated substrate, said platen comprising:

top, bottom, and central portions, a center, an outer periphery, and a platen surface, said bottom portion having a bottom surface and at least one channel formed in the bottom surface, said channel extending from said outer periphery to said central portion of said platen surface, said channel having a width W, a depth, a length Y, and a centerline, said depth of said channel increases along a portion of its length Y, and said depth of said channel being greatest at said central portion of said platen surface.

2. The platen as recited in claim 1 wherein said platen comprises a plurality of said channels respectively separating a plurality of said substantially flat bottom surface portions.

3. The platen as recited in claim 2 wherein the platen further comprises six heating units, one of each of said heating units being disposed between adjacent channels.

4. The platen as recited in claim 2 wherein said centerlines of said channels are spaced 60° apart.

5. The platen as recited in claim 4 wherein said channels comprise between 2% and 5% of a gross surface area of said platen surface.

6. The platen as recited in claim 1 wherein said platen is an integral piece.

7. The platen as recited in claim 1 wherein said depth of said channel is between 0.2 inches (0.51 cm) and 1.0 inches (2.54 cm) at the outer periphery of said platen surface, said depth of said channel being between 1.0 inches (2.54 cm) and 3.0 inches (7.62 cm) at said central portion of said platen surface.

8. The platen as recited in claim 1 wherein said width W of said of channel is between the range of 0.125 inches (0.32 cm) and 0.250 inches (0.64 cm).

9. The platen as recited in claim 1 wherein said platen surface of said platen is substantially flat.

10. The platen as recited in claim 1 wherein the depth of said channel increases uniformly from said outer periphery of said platen to said central portion of said platen.

11. The platen as recited in claim 1 wherein the depth of said channel begins to increase at a point located on said centerline of said channel between 1.0 inches (2.54 cm) and 6.0 inches (15.24 cm) from said center of said platen.

12. The platen as recited in claim 1 wherein said depth of said channel increases along a first portion of said length of said channel, said first portion being equal to 25 % of its total length Y.

13. A platen for heating and liquefying materials, said platen comprising:

a body formed of heat conducting material, said body having a periphery, a substantially flat outer platen surface and a central portion with an opening communicating with the outer platen surface for passing liquefied material through the body, and a plurality of open channels formed in the outer platen surface, said channels being in fluid communication with said opening and having a first depth proximate said periphery and a second depth closer to said central portion, wherein said second depth is greater than said first depth.

14. The platen of claim 13, wherein said outer platen surface is a planar surface.

15. A method of liquefying material, the method comprising:

heating a platen having a substantially flat outer platen surface communicating with at least one open channel which intersects said outer platen surface and increases in depth from a peripheral portion to a central portion of said platen, engaging the outer platen surface with said material in an unliquefied form to liquefy a portion of said material, and directing the liquefied portion through said open channel and into an opening formed in said central portion.

16. The method of claim 15 further comprising:

directing the liquified portion through a plurality of said channels.

17. The platen of claim 1, wherein the adhesive has a typical melt layer thickness and the depth of said channel is between 1.5 times and 2.5 times the typical melt layer thickness of the adhesive.

18. The platen of claim 1, wherein the adhesive has a typical melt layer thickness and said depth is a function of a radial position r, where r is a radial distance from said outer periphery of said platen, said depth being equal to:

$$D = \left(\frac{K}{W}\right) * \prod * (R^2 - r^2),$$

where, D=depth; R=radius of the platen; r=radius at which the depth D is being evaluated; K=a constant to relate area creating flow to area receiving flow, W=2 * t, and, t=the typical molten layer thickness.

* * * * *